United States Patent [19]

Ellis, Jr. et al.

[11] 3,983,352

[45] Sept. 28, 1976

[54] ROTARY SELECTOR SWITCH

[75] Inventors: Richard B. Ellis, Jr.; James R. Wilson, both of Kokomo, Ind.

[73] Assignee: General Motors Corporation, Detroit, Mich.

[22] Filed: May 12, 1975

[21] Appl. No.: 576,465

[52] U.S. Cl. ..... 200/11 J; 200/11 C

[51] Int. Cl.[2] ..... H01H 21/22

[58] Field of Search ..... 200/11 R, 11 D, 11 DA, 200/11 E, 11 EA, 11 G, 11 J, 11 K, 11 TW, 336, 293–296, 303, 291, 292, 11 C

[56] References Cited

UNITED STATES PATENTS

| | | | |
|---|---|---|---|
| 3,222,490 | 12/1965 | Huntress et al. | 200/11 TW UX |
| 3,346,708 | 10/1967 | Morra | 200/11 G |
| 3,517,956 | 5/1970 | Fields | 200/336 |
| 3,594,527 | 7/1971 | Brant et al. | 200/293 X |
| 3,819,883 | 6/1974 | Heap | 200/11 J |

*Primary Examiner*—James R. Scott
*Attorney, Agent, or Firm*—Kenneth H. MacLean, Jr.

[57] ABSTRACT

An improved rotary-type selector switch for fan speed control or the like including curved terminal members supported upon a base member around a central boss extending therefrom and having a conductive contactor for selectively interconnecting said terminal members when said contactor is pivoted. A cover member is attached to the contactor for pivotal movement together and retains springs which push the contactor against the terminal members and permit movement of the cover toward the contactor. The aforedescribed parts are assembled by a pin fastener with an expandable first end portion which engages the base in snap-fitting relation and an enlarged second end portion overlying the cover member. Circumferentially spaced detent means and a projecting ridge formed between the pin fastener and the cover operably engage one another positively to locate the cover and connected contactor in a plurality of annular positions with respect to the base member.

3 Claims, 6 Drawing Figures

ROTARY SELECTOR SWITCH

This invention relates to rotary-type selector switch assemblies and more particularly to a rotary switch which utilizes a pin-type fastener secured to a base member and having a head portion overlying the rotative portions of the switch with locating means therebetween to position the rotative portions with respect to the base in a plurality of annular operative positions.

The subject selector switch assembly includes a base member with a centrally located boss extending therefrom, terminal members with arcuate portions are fastened to the base member and surround the boss, a one-piece contactor with contacts extending therefrom, a cover member operably attached to the contactor for pivotal movement therewith about the boss, springs between the cover and contactor to bias the contactor against the terminals and a fastener with an expandable first end portion connected in snap-fitting operative relation to the boss and having an enlarged second end portion overlying the cover member to secure the assembly together.

The aforedescribed assembly has very few parts. The operative annular positions of the switch are established by engagement between a plurality of circumferentially spaced depressions or detents and a ridge located between the head of the pin fastener and the cover member. When the cover and contactor are pivoted with respect to the base, the cover is moved downward on the boss against the contactor by engagement of the ridge with cover portions between the detents. After alignment of the ridge with a groove or detent, the cover is permitted to move outward on the boss and this movement between detents can be sensed through the cover member by an operator by touch and hearing.

The aforementioned ridge and detent means for precisely positioning the contactor and terminal members permits the switch assembly to be reduced in size without sacrificing desirable operation. The small number of parts of this rotary switch also contributes to the compactness as well as its economical manufacture. The construction of the switch assembly is such that automatic assembly is desirable since the parts are assembled sequentially in overlying relation to one another and held together by a final insertion of the pin fastener.

Therefore, an object of the present invention is to provide a simple and compact rotary selector switch assembly which utilizes only a few parts and which is assembled by addition of the parts in sequential overlying fashion.

A further object of the present invention is to provide a simple and compact rotary type selector switch whose parts are assembled in sequential overlying fashion followed by the insertion of a snap-action type pin fastener.

A further object of the present invention is to provide a simple and compact rotary-type selector switch in which the rotative portions are held to a base member by a pin-type fastener having an enlarged head portion overlying the rotative portions of the assembly with circumferentially spaced detents between the fastener head and the rotative parts engaged by a ridge portion to accurately and positively position the rotative parts with respect to terminals on the base member.

Further objects and advantages of the present invention will be more readily apparent from the following detailed description, reference being had to the accompanying drawings in which a preferred embodiment is illustrated. In the drawings.

Figure 1:
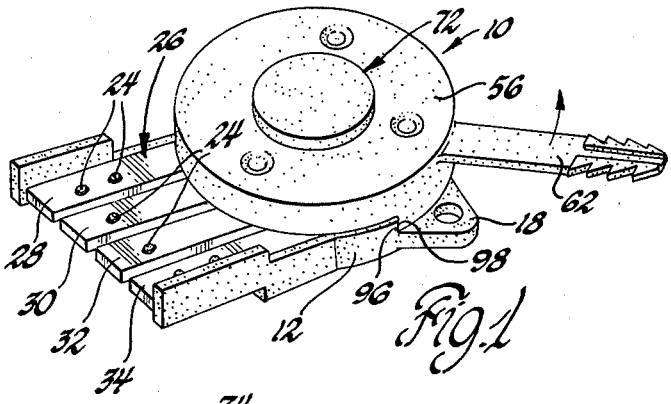
FIG. 1 is a perspective view of the subject rotary selector switch assembly.

In the drawings, the rotary selector switch 10 which is illustrated is utilized where a multiple position switching device is needed such as in blower motor speed control. The rotary switch includes a terminal carrier or base member 12 of plastic material having an upstanding circular post or pivot boss 14 extending from a generally planar surface 16. The base 12 has outwardly extending flange portions 18, 20 for fastening to a support structure. The base 12 includes a radially outwardly extending portion 22 forming a continuation of surface 16 which has upwardly extending posts 24 to secure a metal terminal assembly 26 to the base. The terminal assembly 26 includes four separate members 28, 30, 32 and 34 each having openings 36 through which the aforementioned posts 24 extend. The upper ends of the posts 24 are adapted to be enlarged after assembly by a heat application or ultrasonically to secure the terminals to the base 12.

Although the initial form of the terminals is not specifically shown in the drawings, it is contemplated that the terminal assembly 26 may be made in one piece with bridging portions between the individual terminal members 28, 30, 32 and 34. These bridging portions in a preferred embodiment would overlie openings 38, 40 and 42 so that once the piece assembly 26 is positioned on the base member 12 by posts 24, punches would be run through the openings 38, 40 and 42 to remove the bridge portions and separate the terminals.

More specifically, the terminal assembly 26 includes straight connection portions 28′, 30′, 32′, 34′ and arcuately shaped or semi-circular portions 28″, 30″, 32″ and 34″. When attached to the base 12, the portions 28″, 30″, 32″, 34″ encircle the boss 14 and are separated one from another by raised bridge portions 44 of the base 12. The arcuate portions of the terminal 26 and the raised bridge portions 44 define a circular track about said boss 14 which is adapted to be slidingly engaged by downwardly struck, semi-spherical dimples or contacts 46, 48 and 50 formed in a contactor plate 52. The contactor 52 has a central opening 54 adapted to encircle the boss 14 to guide the contactor 52 in rotative movement with respect to the terminals.

A generally cup-shaped plastic cover member or carrier 56 with a central opening 58 overlies the contactor 52 and is guided in its rotative movement therewith by the extension of boss 14 into opening 58. Inwardly extending portions of the cover member 56 engage diametrically opposed notches 60 formed in the contactor 52 to cause the contactor 52 and cover member 56 to rotate together when the outwardly extending handle portion 62 is moved. The end of the handle 62 is serrated or formed with hooked portions 64 so that a decorative and easily grasped knob portion may be press fit thereon.

Three springs 66, 68 and 70 are supported between the contactor 52 and the cover member 56 with their lower ends supported within dimples 46, 48, 50. The springs 66, 68, 70 exert a downward force upon the contactor 52 to cause engagement between the terminals and the contacts 46, 48 and 50.

Figure 3:
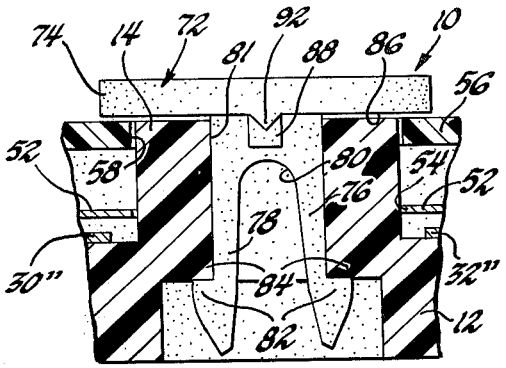
FIG. 3 is an enlarged elevational side view of the snap acting pin fastener shown in FIGS. 1 and 2.
Figure 4:
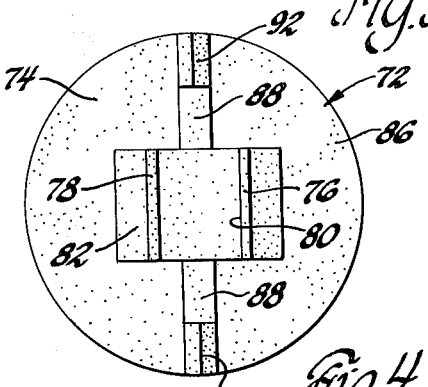
FIG. 4 is a bottom view of the snap fastener shown in FIG. 3.
Figure 5:
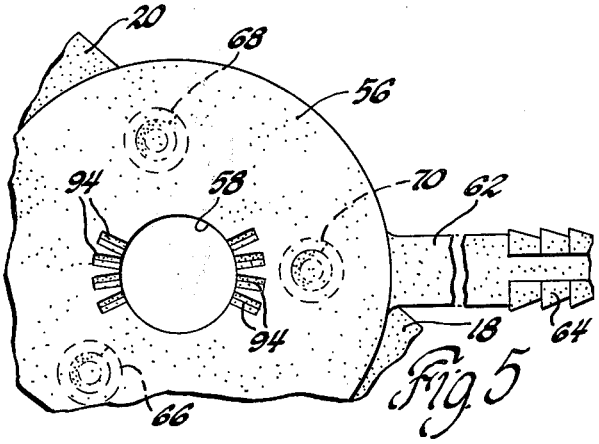
FIG. 5 is a fragmentary planar view of the switch shown in FIG. 1.
Figure 2:
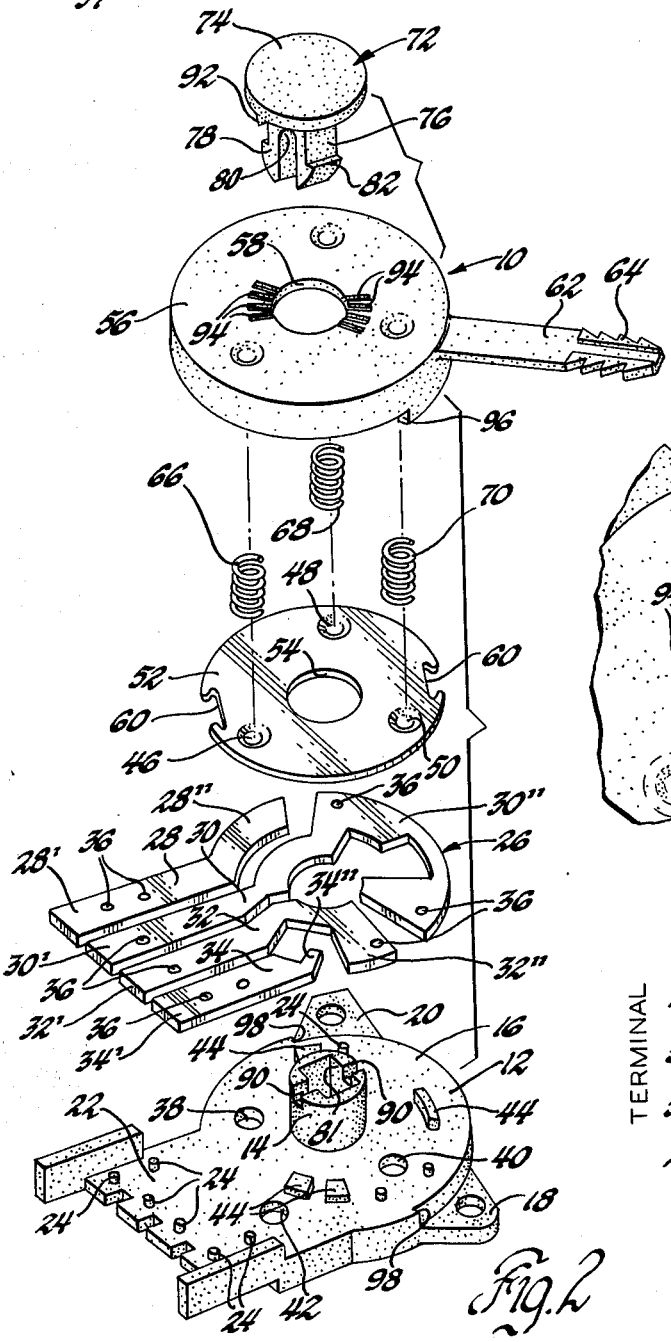
FIG. 2 is a perspective view of the switch assembly with its parts separated one from another to better reveal the internal structure.

The cover 56 is secured to the base 12 against the force of spring 66, 68 and 70 by a snap action pin fastener 72 preferably made of acetal resin and best shown in FIGS. 3 and 4. The fastener 72 includes an enlarged diameter head portion 74 which extends over the central portion of the cover 56. Extending downward from the enlarged head portion 74 are two relatively thin leg portions 76, 78 separated by a central groove or channel 80 to impart some degree of radial flexibility to the leg portions. The leg portions 76, 78 extend into an opening 81 centrally located in boss 14. The lower ends of the leg portions 76, 78 terminate in hook-like portions with shoulders 82 thereon adapted to engage the edge portion 84 of the base 12. The legs 76, 78 are flexible permitting movement toward one another to enable the shoulders 82 to be inserted into the opening 81.

The underside 86 of retainer head 74 has a radially extending ridge 88 formed at two diametrically opposed positions the inner portion of which engage slots 90 in boss 14 to positively secure the fastener 72 to base 12 to prevent relative rotation therebetween. The ridge portion 88 outwardly from the boss 14 is shaped with a generally triangular cross section to present a projecting edge or tang 92 facing the upper surface of cover 56. A plurality of circumferentially spaced depressions or detents 94 are formed in the upper surface of cover 56 at two diametrically opposed locations for engagement with the tangs 92 as the cover 56 is pivoted around boss 14. The pivoting motion of cover 56 moves the tang 94 between the adjacent detents 94 and resultantly positions the cover 56 and interconnected contactor 52 with respect to the terminals. As tangs 94 move between detents, the cover is forced downwardly on boss 14 against springs 66, 68, 70.

Figure 6:
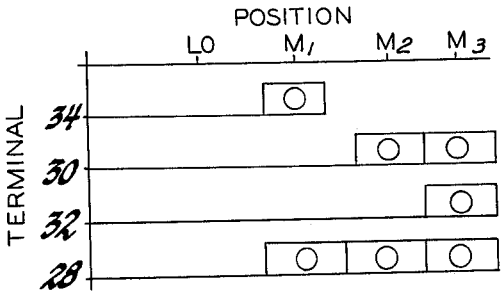
FIG. 6 is a schematic illustration of the connections formed by the switch in its four operative positions.

In FIG. 6, a graphic representation of switch operation is shown. The vertical column represents the separate terminal portions of the assembly 26 and the horizontal axis represents the four positions of arm 62 as it is pivoted from the position shown in FIG. 1 counterclockwise. In the low position, the contacts 46, 48 and 50 of contactor 52 engage the raised portion 44 on base 12 and therefore no connections are made between the terminals. When the handle 62 is moved one operative position so that ridge 92 moves one detent counterclockwise, the contact 46 engages portion 34'' and the contact 48 engages portion 28'' to complete a circuit therebetween through the contactor 52. When the handle 62 is moved further counterclockwise as defined by the detents 94, the contact 46 moves out of engagement with portion 34'' and onto one of the raised portions 44 while contact 50 moves into contact with portion 30'' and contact 48 touches portion 28'' to complete a circuit through the contactor 52. When the handle 62 is pivoted to its furthermost counterclockwise position as defined by the detents 94, contact 46 engages portion 32'', contact 50 engages portion 30'' and contact 48 engages portion 28'' to complete a circuit between terminal portions 28, 30, and 32.

The coaction between the angled tang 92 and the grooves 94 accurately positions the cover 56 and conductor plate 52 to locate contacts 46, 48, 50 in engagement with the proper semi-circular portions of the terminal assembly 26. The snap action caused by movement of the tangs 92 into and out of the detents 94 accompanied by downward movement of the cover 56 with respect to base 12 enables the operator to both feel and hear the different operative positions of the switch assembly.

A final feature of the subject switch assembly is the formation of the downwardly extending skirt portion 96 which has end surfaces thereon which engage stop shoulders or abutments 98 of base 12 to limit the pivotal motion of the cover 56 to the aforementioned positions.

Although the previous detailed description and the drawings describe and illustrate a preferred embodiment, other embodiments within the scope of the invention may be adapted and it is particularly obvious that an identical operation could be performed by forming detents 94 on the underside of the fastener 72 and the tang 92 on the upper surface of the cover member 56.

What is claimed is as follows:

1. A rotary-type selector switch comprising: a base member of plastic material having a substantially flat surface with a boss projecting therefrom; a plurality of conductive terminal members attached to said base with arcuate portions arranged around said boss defining a generally circular track thereabout; a conductive contactor overlying said terminals and engaging said boss for rotative movement thereabout; contact means extending from the plane of said contactor into engagement with said circular track for making electrical connections between separate terminal members as said contactor is rotated about said boss; a cover member overlying said contactor and attached thereto for rotative movement together with respect to said base; spring means between said contactor and said cover thereby forcing said contacts into engagement with said arcuate terminal portions; a retainer attached to said boss and having an enlarged head portion overlying said cover to maintain said contactor and cover in spaced relation to said base; means including a projecting tang and circumferentially spaced detents between said enlarged head portion and said cover for selective engagement with one another as said cover and contactor are rotated with respect to said base member thereby positively positioning said contactor and the contacts thereon with respect to said arcuate terminal portions in predetermined angular positions along said circular track.

2. A rotary-type selector switch comprising: a base member of plastic material having a substantially flat surface with a boss projecting therefrom; a plurality of conductive terminal members attached to said base with arcuate portions arranged around said boss; said base having raised portions with respect to said flat surface located between adjacent arcuate terminal portions to define a generally even circular track about said boss; a conductive contactor overlying said terminals and engaging said boss for rotative movement thereabout; contact means extending from the plane of said contactor into engagement with said circular track for making electrical connections between separate terminal members as said contactor is rotated about said boss; a cover member overlying said contactor and attached thereto for rotative movement together with respect to said base; spring means between said contactor and said cover thereby forcing said contacts into engagement with said arcuate terminal portions; said boss having an axially extending opening therein; a retainer with radially expandable leg portions having shoulders formed thereon adapted to be inserted into said boss opening until said shoulders clear an edge of said base member permitting radial movement of said leg portions and resulting engagement between said shoulders and edge to thereby secure said retainer to said boss; said retainer having an enlarged head portion overlying said cover member to maintain said contactor and cover member in spaced relation to said base; means including a projecting tang and circumferentially spaced detents between said enlarged head portion and said cover for selective engagement with one another as said cover and contactor are rotated with respect to said base member thereby positively positioning said contactor and the contacts thereon with respect to said arcuate terminal portion in predetermined angular positions along said circular track.

3. A rotary-type selector switch comprising: a base member of plastic material having a substantially flat surface with a boss projecting therefrom; a plurality of conductive terminal members attached to said base with arcuate portions arranged around said boss; said base having raised portions with respect to said flat surface located between and bridging adjacent arcuate portions to define a generally even circular track about said boss; a conductive contactor overlying said terminals and engaging said boss for rotative movement thereabout; contact means extending from the plane of said contactor into engagement with said arcuate terminal portions and raised bridge portions for electrically connecting selective terminal members when said contactor is rotated about said boss; a cover member overlying said contactor and attached thereto for rotative movement together with respect to said base; spring means between said contactor and said cover thereby forcing said contacts into engagement with said arcuate terminal portions; a retainer attached to said boss and having an enlarged head portion overlying said cover to maintain said contactor and cover in spaced relation to said base; means including a projecting tang and circumferentially spaced detents between said enlarged head portion and said cover for selective engagement with one another as said cover and contactor are rotated with respect to said base member thereby positively positioning said contactor and the contacts thereon with respect to said arcuate terminal portions in predetermined angular position along said circular track; means including an abutment formed on said base member and a semicircular skirt with end portions on said cover limiting the extreme pivotal movement of said cover with respect to said base by engagement between said abutment and skirt end portions.

* * * * *